US006796774B2

(12) United States Patent
Stölzer

(10) Patent No.: US 6,796,774 B2
(45) Date of Patent: Sep. 28, 2004

(54) AXIAL PISTON ENGINE

(75) Inventor: Rainer Stölzer, Neu-Ulm (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 46 days.

(21) Appl. No.: 10/220,325

(22) PCT Filed: Feb. 28, 2001

(86) PCT No.: PCT/EP01/02255

§ 371 (c)(1),
(2), (4) Date: Aug. 29, 2002

(87) PCT Pub. No.: WO01/94751

PCT Pub. Date: Dec. 13, 2001

(65) Prior Publication Data

US 2003/0010195 A1 Jan. 16, 2003

(30) Foreign Application Priority Data

Jun. 8, 2000 (DE) ..... 100 28 336

(51) Int. Cl.[7] ..... F04B 1/12; F04B 1/26; F01B 1/00; F01B 13/04; F01B 3/00

(52) U.S. Cl. ..... 417/269; 417/222.1; 91/486; 91/499; 92/71

(58) Field of Search ..... 91/486, 499, 507; 417/269, 222.1; 92/71; 184/6.17; 403/359.5, 253, 254

(56) References Cited

U.S. PATENT DOCUMENTS

| | | | | | |
|---|---|---|---|---|---|
| 2,776,628 A | | 1/1957 | Keel | 91/507 |
| 3,139,038 A | | 6/1964 | Stewart | 91/507 |
| 3,253,844 A | * | 5/1966 | Altmann | 403/254 |
| 3,675,539 A | * | 7/1972 | Zajac et al. | 91/477 |
| 3,698,287 A | * | 10/1972 | Martin | 91/507 |
| 5,391,123 A | * | 2/1995 | Forster | 475/83 |
| 5,784,949 A | * | 7/1998 | Ryken et al. | 92/57 |

FOREIGN PATENT DOCUMENTS

| | | |
|---|---|---|
| DE | 32 22 210 A1 | 12/1983 |
| DE | 198 28 429 A1 | 2/1999 |

* cited by examiner

*Primary Examiner*—Justine R. Yu
*Assistant Examiner*—Timothy P. Solak
(74) *Attorney, Agent, or Firm*—Scully, Scott, Murphy & Presser

(57) ABSTRACT

An axial piston engine (1), including a housing (2) in whose inner compartment (4) a cylinder drum (17) and a swash plate (26) located axially adjacent thereto are situated. Several piston bores (21), which extend approximately parallel to the central axis of the cylinder drum (17) are located in the same, pistons (23) being displaceably guided in the piston bores. The ends of the pistons facing towards the swash plate (26) are supported on the swash plate (26). A driving shaft (7) is rotatably mounted in the housing (2) and is connected to the cylinder drum in a fixed manner secured against rotation therebetween by a multitooth coupling (19) comprising teeth (43*a*, 44*a*) and tooth spaces (43*b*, 44*b*) which alternate regularly in a peripheral direction and which engage with each other. At least one feedthrough channel (45) which extends essentially parallel to the axis of rotation of the drive shaft (7) and from one side of the multitooth coupling (19) to the other is located in the area of the multitooth coupling (19). Obtained is a flow feedthrough and/or a mechanical feedthrough from one side of the multitooth coupling to the other while ensuring that the multitooth coupling is stable and simple to produce. To this end the feedthrough channel (45) is located between at least one tooth crown or tip surface (43*d*) and a tooth space bottom (444) located opposite thereto.

13 Claims, 3 Drawing Sheets

AXIAL PISTON ENGINE

BACKGROUND OF THE INVENTION

1. Field of the Invention

The invention relates to an axial piston engine which, while affording a stable construction, provides for a multitooth coupling facilitating a fluid flow penetration and/or mechanical penetration between opposite sides of the multitooth coupling.

An axial piston engine of said type is described in DE 32 22 210 A1.

2. Discussion of the Prior Art

In axial piston engines it is known to utilize the housing interior as an intermediate collecting container for leakage fluid. In the operating mode of the axial piston engine, in the housing interior a specific amount of leakage oil collects, which is under low pressure and flows off through a discharge gap or discharge channel to a tank. The leakage fluid situated in the housing interior may be used to lubricate moving parts of the axial piston engine. It is moreover advantageous when the leakage fluid is present as a film between the seating surfaces of parts which are not movable relative to one another, thereby preventing or at least reducing contact corrosion and abrasion resulting from vibrations. It is further advantageous when the hydraulic fluid may travel with as little hindrance as possible to the desired lubricating points. This is not guaranteed when in the housing interior there is a barrier preventing a desired feed of the fluid to the lubricating point. Such a barrier is formed by a multitooth coupling between two parts of the axial piston engine in the housing interior of the latter. The purpose of a multitooth coupling is to connect two parts rigidly to one another, e.g. prevent them from rotating relative to one another. In the axial piston engine of the initially indicated type, such a multitooth coupling may be provided between a driving shaft and a cylinder drum mounted thereon. Since a multitooth coupling is to transmit considerable coupling forces, the aim is to fashion the mutually adjacent surfaces of the multitooth coupling not only in the region of the tooth flanks and the tooth spaces in such a way that they fit substantially tightly against one another. As a result, the multitooth coupling forms a liquid barrier, which prevents or at least reduces the access of the hydraulic fluid to both sides of the multitooth coupling.

From the previously mentioned DE 32 22 210 A1 it is also known for a support ring, which is mounted on the driving shaft and has a spherical segment-shaped support surface for a retaining plate for holding back sliding pads, to be positioned in the operating position by means of axially disposed thrust pins lying opposite one another on the periphery of the driving shaft, wherein the thrust pins are mounted in a sliding displaceable manner in bores, which extend in the region of the multitooth coupling between the support ring at the one side of the multitooth coupling and a thrust ring at the other side of the multitooth coupling. The thrust ring is biased by a pressure spring towards the thrust pins and towards the support ring, wherein the end of the pressure spring remote from the thrust ring biases the cylinder drum elastically towards a cam disk. In said development too, the multitooth coupling forms a barrier preventing the fluid from flowing from the one side of the multitooth coupling to the other. In the known development this is particularly problematical because the fluid is prevented from flowing into an annular clearance zone between the driving shaft and the cylinder drum. A rolling-contact bearing disposed in the region of a cam disk and provided for mounting the driving shaft rotatably on the relevant housing wall is therefore cut off from being intensively flushed, lubricated and cooled by the hydraulic fluid.

Furthermore, the gearing is weakened if the bores for the thrust pins extend right through the middle of the teeth or if a tooth is left out in the region of a thrust pin. DE 198 28 429 A1 describes an axial piston engine having a return apparatus comprising thrust pins, which is similar to the previously described return apparatus. In said previously known development, three thrust pins arranged so as to be distributed over the periphery are displaceably mounted in each case in a first through-channel, which is disposed in the root region of a missing tooth of the cylinder drum. In said non-generic development, the missing teeth form two through-channels for the fluid. In said development too, the stability and/or strength of the toothed ring coupling is impaired because of the missing teeth.

SUMMARY OF THE INVENTION

The underlying object of the invention is to develop an axial piston engine of the initially indicated type in such a way that, while simultaneously guaranteeing a stable construction, the multitooth coupling enables a flow penetration and/or a mechanical penetration from one side of the multitooth coupling to the other.

Said object is achieved by the features as described herein. Advantageous developments of the invention are described in the sub-claims.

In the construction according to the invention a flow of fluid through the through-channel from one side of the multitooth coupling to the other is possible so that in the operating mode the fluid reaches both sides of the multitooth coupling and the lubrication in said regions is guaranteed. Since the at least one through-channel according to the invention is disposed in a tooth tip surface and/or in an opposing tooth space bottom surface, it is situated in a region which is insensitive to weakening and the flanks of the teeth and/or tooth spaces are unimpaired.

As the main load zone of the multitooth coupling is situated in the region of the flanks, the construction according to the invention leads neither to a substantial weakening of the cross section of the teeth nor to a reduction of the compressive load per unit area. The stability and endurance of the multitooth coupling are therefore maintained despite the presence of one or more through-channels arranged so as to be distributed over the periphery.

For fluidic reasons it is advantageous to dispose a plurality of through-channels preferably so that they are distributed uniformly over the periphery of the gearing. It is also possible to dispose the through-channel only in one of the mutually opposing tooth tip surface and tooth space bottom surface or in a mutually opposing manner in both surfaces. The latter leads to a common through-channel of enlarged cross section.

The cross-sectional shape of the at least one through-channel may differ and be adapted to constructional conditions. A rounded or half-round or U-shaped cross-sectional shape is advantageous for avoiding a notch effect. The cross-sectional shape may however also be polygonal or hollow wedge-shaped, this being advantageous for reasons of manufacture and for additional reasons explained further below.

The at least one through-channel according to the invention may however also be used to receive a pin as part of the axial piston engine, e.g. a previously described thrust pin extending between two axially movable components disposed on either side of the multitooth coupling, e.g. between a pressure spring and a support ring for a return device. The thrust pin penetrates the through-channel and may, for example, be guided slidingly therein with slight motional clearance. In said case, the through-channel is used not to create a flow connection between both sides of the multitooth coupling but to enable a mechanical connection extending through the through-channel and, indeed, likewise without substantially impairing the stability of the gearing.

In said case, the pin may be slideably guided in the through-channel with slight motional clearance, so that a fluid penetration is not provided. When the at least one through-channel is designed with a cross section sufficiently larger than the pin, the construction according to the invention may form a passage both for the mechanical connection and for the fluid.

The through-channel is open towards the tooth tip surface and/or tooth space bottom surface. The advantage of said construction is that the at least one through-channel may be manufactured easily and inexpensively in the form of a groove, e.g. by a cutting operation using a slotting tool, a broaching tool, a roller-type hammering tool or a milling tool, especially with inclusion of the profile in the milling cutter geometry.

BRIEF DESCRIPTION OF THE DRAWINGS

There now follows a detailed description of the invention and further advantages achievable thereby by way of preferred constructions of an advantageous embodiment. The drawings show.

DETAILED DESCRIPTION OF THE INVENTION

Figure 1:
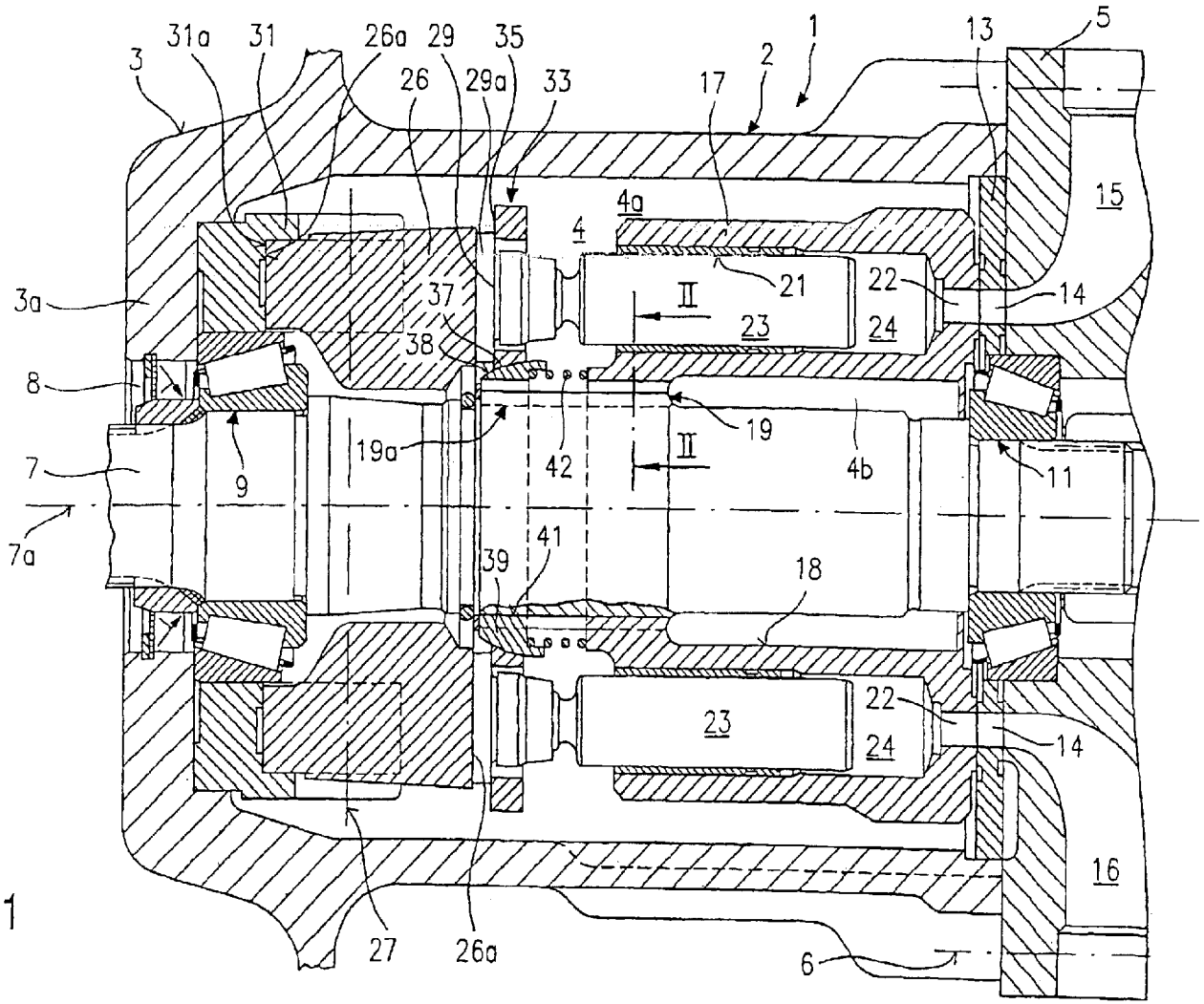
FIG. 1 an axial section through an axial piston engine according to the invention.

The axial piston engine 1 illustrated by way of example has a closed housing 2 comprising a pot-shaped housing part 3, the housing interior 4 of which is closed detachably by means of a so-called connecting part 5, which is fastened in the sense of a lid to the free edge of the housing part 3 by means of screws 6, which are implied in the drawing. Mounted rotatably in the housing 2 is a driving shaft 7, which penetrates the bottom wall 3*a* of the pot-shaped housing 3 in a bearing hole 8 and is supported in a freely rotatable manner by rolling-contact bearings 9, 11 indirectly or directly against the bottom wall 3*a* of the pot-shaped housing 3 in a bearing hole 8 and is supported in a freely rotatable manner by rolling-contact bearings 9, 11 indirectly or directly against the bottom wall 3*a* of the pot-shaped housing 3 and against the connecting part 5. Disposed on the inside of the connecting part 5 is a cam disk 13 having control channels 14, which extend opposite one another substantially parallel to the axis of rotation 7*a* of the driving shaft 7 and are connected respectively to a feed line 15 and a discharge line 16 in the connecting part 5. Adjoining the inside of the cam disk 13 is a cylinder drum 17, which is seated by means of an oblong hole 18 on the driving shaft 7 and connected thereto so as to be rotatably in conjunction therewith by means of a multitooth coupling 19, which in the present embodiment is disposed only in an end region of the cylinder drum 17 remote from the cam disk 13 and in a longitudinal region of the driving shaft 7 radially adjacent to said end region.

A plurality of substantially paraxially extending piston bores 21 are disposed in the cylinder drum 17 so as to be distributed over the periphery and are connected at their ends facing the control channels 14 by tapered feed and discharge channels 22 to the control channels 14 and open out of the cylinder drum 17 at the end remote from the cam disk 13. Supported in an axially reciprocating manner in the piston bores 21 are pistons 23, which with their ends facing the cam disk 13 delimit working chambers 24 in the piston bores 21 and with their top ends remote from the cam disk 13 project from the cylinder drum 17 and are axially supported by means of supporting joints 25, in particular ball joints, in an obliquely extending transverse plane against an inclined plate 26. In the case of a present, swash plate-style axial piston engine 1, the inclined plate 26 is formed by a so-called swash plate, which is mounted, in an axial piston engine 1 with a fixed throughput rate, rigidly and, in an axial piston engine 1 with a variable throughput rate, pivotally about a swivelling axis 27 extending at right angles to the axis of rotation 7*a* and is adjustable by means of an, as such, known and non-illustrated adjusting apparatus and lockable in the position adjusted in each case. For said purpose, hollow cylinder segment-shaped bearing surfaces 31*a* on the swivel plate and on a pivot bearing may be used. The swash plate at its side facing the cylinder drum 17 has an inclined surface 26*a*, against which the pistons 23 are supported by means of sliding pads 29, which are connected by the support joints 25 to the top ends of the pistons 23 so as to be capable of swivelling in all directions.

In the present embodiment, the swash plate 26 is mounted on the bottom wall 3*a*, wherein for said purpose a bearing ring 31 may be provided, which is supported against the bottom wall 3*a* and has a bearing hole, in which the associated rolling-contact bearing 9 is mounted. Disposed in the swash plate 26 is an axial through-hole, through which the driving shaft 7 extends with motional clearance.

In the operating mode of the axial piston engine 1 the driving shaft 7 and the cylinder drum 17 rotate jointly about the axis of rotation 7*a*, wherein the pistons 23 because of the inclined plane on the swash plate 26, here on the inclined surface 26*a*, are displaced to and fro in the piston bores 21. In said case, the axial piston engine 1 may operate in the pump mode or in the motor mode. To prevent the sliding pads 29 from lifting off the inclined surface 26*a*, there is associated with the sliding pads 29 a return apparatus 33, which keeps the sliding pads 29 applied against the inclined surface 26*a* and, in the present embodiment, is formed by a return disk 33 is axially supported by a spherical segment-shaped concave bearing surface 37 against a correspondingly spherical segment-shaped convex bearing surface 38 of a support ring 39, which is mounted by means of a bearing hole 41 in an axially displaceable manner on the driving shaft 7 and supported in the direction of the cylinder drum 17 by a force, which is greater than the lift-off forces. The support ring 39 is preferably connected by a second multitooth coupling 19*a* to the driving shaft 7, so as to be rotatable in conjunction therewith, wherein the teeth 43*a* may be provided jointly for both multitooth couplings and may be correspondingly long.

In order to achieve efficient sealing between the cylinder drum 17 and the cam disk 13, it is advantageous to bias the cylinder drum 17 with an axial elastic force towards the cam disk 13. In the embodiment according to FIG. 1, contact pressure forces for the sliding pads 29 and the cylinder drum 17 are generated by means of a common, axially effective spring 42, which may be disposed e.g. between the support ring 39 and the cylinder drum 17 and presses said parts apart from one another.

Figure 2:
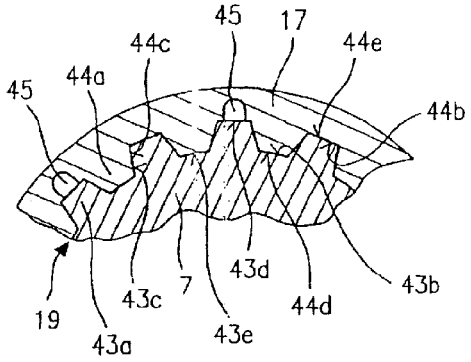
FIG. 2 the partial section II—II in FIG. 1 with several modified constructions.

As may be seen particularly in FIG. 2, the multitooth coupling 19 comprises a plurality of teeth 43*a*, 44*a* and tooth spaces 43*b*, 44*b*, which are disposed on the lateral surface of the driving shaft 7 and on the inner lateral surface of the cylinder drum 17 respectively and arranged in a regular alternating sequence in each case in peripheral direction and of which the main shape and size are in each case designed in such a way that the teeth substantially fill the tooth spaces. During the rotational coupling in the operating mode the teeth are loaded in each case in peripheral direction, wherein pressure forces acting in peripheral direction are transmitted and generate a specific compressive load per unit area at the tooth flanks 43*c*, 44*c* delimiting the teeth 43*a*, 44*a*. The surfaces extending between the flanks 43*c*, 44*c* are denoted by tip surfaces 43*d*, 44*d* and tooth space bottom surfaces 43*e*, 44*e*.

By virtue of the shaping described thus far, the multitooth coupling 19 because of the relatively close contact forms a blocking wall or barrier preventing a flow of the fluid between the interior portions 4*a*, 4*b* disposed on either side of the multitooth coupling 19. In order to enable a flow and hence an exchange of fluid between the interior portions 4*a*, 4*b*, the gearing has, preferably in the middle of at least one tooth tip surface 43*d*, 44*d* and/or at least one tooth space bottom surface 43*e*, 44*e* of the driving shaft 7 and/or of the cylinder drum 17, a through-channel 45, which therefore connects the two interior portions 4*a*, 4*b* to one another so that a flow may occur. By said means the lubrication of respective associated surfaces is improved and wear, abrasion and contact corrosion are prevented or at least reduced. When one interior portion 4*a*, 4*b* is connected to a leakage outlet, the through-channel is also used to connect the other interior portion 4*b* to the leakage outlet.

The at least one through-channel 45, because of its opening out towards the associated tip surface or bottom surface 43*d*, 44*d*, 43*e*, 44*e*, has a groove which may be manufactured in one working step with the tooth profile, e.g. by means of a broaching, slotting or roller-type hammering tool. In order to enlarge the cross-sectional area of the through-channel 45, it is advantageous to dispose through-channels 45 radially opposite one another in both mutually opposing tooth tip surfaces 43*d* and/or 44*d* and tooth space bottom surfaces 43*e* and/or 44*e*. When a plurality of through-channels 45 are arranged opposite one another or on their own and distributed over the periphery, the effective flow cross section may be increased further.

Figure 3:
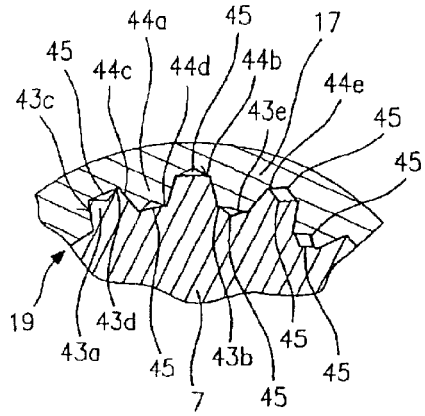
FIG. 3 a section corresponding to the partial section in a further modified construction.
Figure 5:
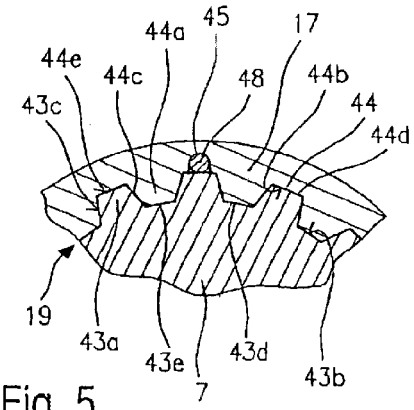
FIG. 5 the partial section V—V in FIG. 4.
Figure 6:
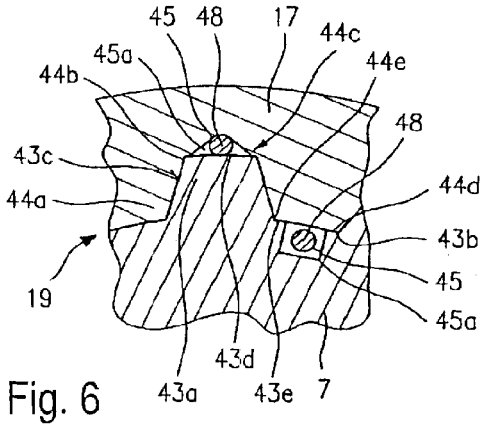
FIG. 6 a section corresponding to the partial section V—V in modified constructions and FIG. 7 a section corresponding to the partial section V—V in further modified constructions.
Figure 7:
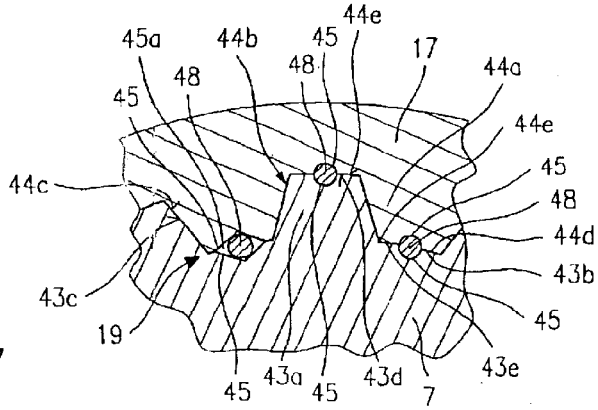
Figure 4:
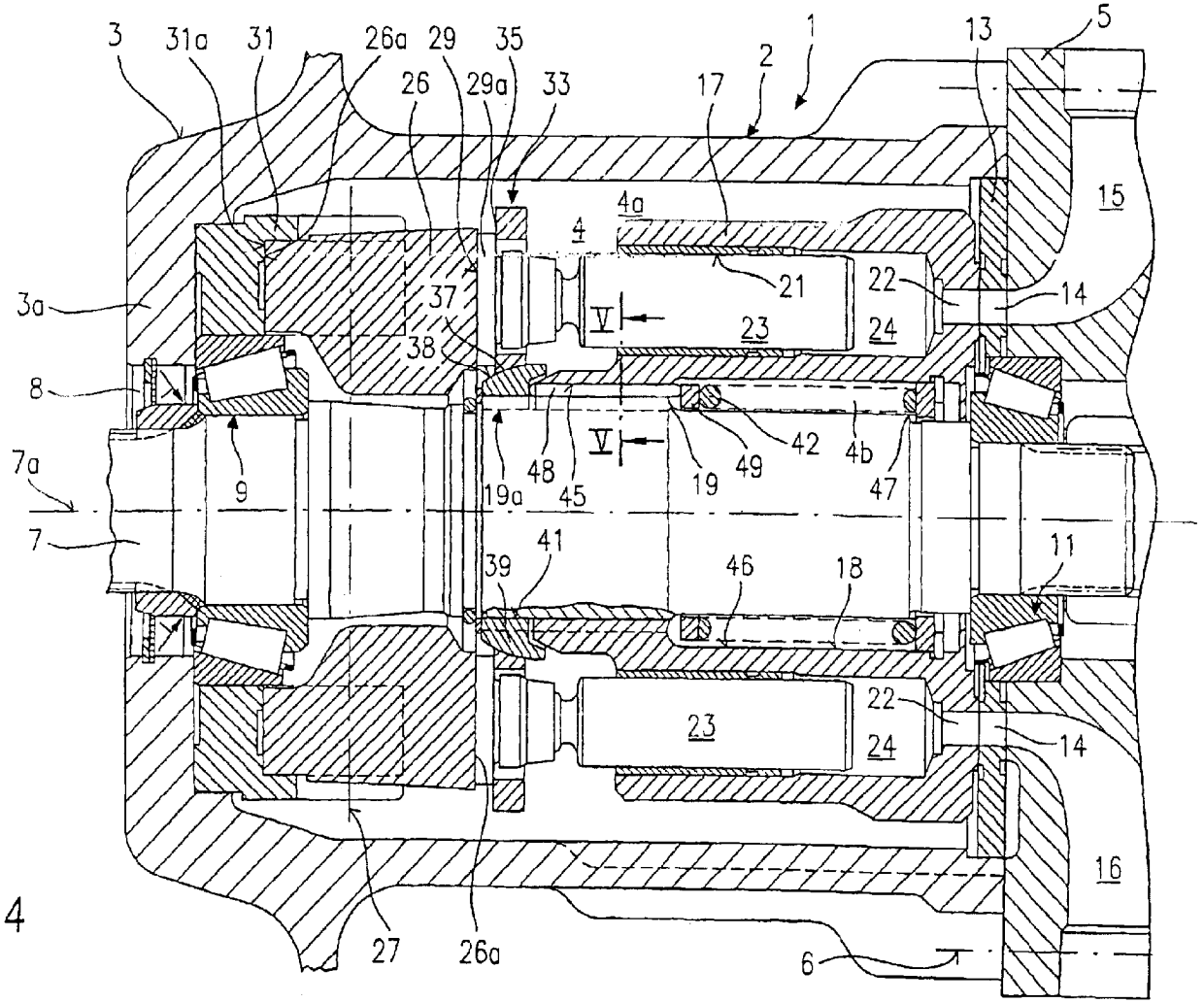
FIG. 4 an axial section through an axial piston engine according to the invention in a further modified construction.

The cross-sectional shape of the at least one through-channel 45 may be rounded (FIGS. 2 and 5) or curved in the shape of a circular arc segment (FIG. 7) or polygonal (FIGS. 3 and 6), e.g. square or triangular. In said case, the through-channels 45 may be disposed in the tooth tip surfaces 43*d*, 44*d* and/or in the tooth space bottom surfaces 43*e*, 44*e* of the driving shaft 7 and/or of the cylinder drum 17 so as to succeed one another directly in peripheral direction or to skip one or more tooth tip surfaces 43*d*, 44*d* and/or tooth space bottom surfaces 43*e*, 44*e*. The embodiments described above and yet to be described may be used either in combination or each on their own.

In the embodiments according to FIGS. 4 to 7, in which identical or comparable parts are provided with identical reference characters, the spring 42 is disposed at the side of the multitooth coupling 19 facing the cam disk 13 in an annular space disposed between the cylinder drum 17 and the driving shaft 7 and is preferably formed by a cylindrical helical spring, which with its end facing the cam disk 13 presses against an inner shoulder surface 47 of the cylinder drum 17 and biases the latter towards the cam disk 13. The end of the spring 42 remote from the cam disk 13 biases the return apparatus 33 by means of a plurality of mutually opposed axial thrust pins 48, which extend in each case through a through-channel 45 as far as the support ring 39. A thrust ring 49 may be disposed between the thrust pins 48 and the spring 42. The length of the thrust pins 48 is greater than the axial length of the multitooth coupling 19 so that they project into the annular space 46. A plurality of thrust pins 48 distributed over the periphery and a plurality of through-channels 45 for receiving them are provided in order to distribute the axial contact pressure over the periphery.

In said embodiments, the through-channels 45 form axial guides for the thrust pins 48. When the shape and size of the cross section of the through-channels 45 is adapted with a slight motional clearance to the shape and size of the cross section of the thrust pins 48, the through-channels 45 exclusively perform a guide function for the thrust pins 48. In such a case, by means of another flow passage it may be ensured that the fluid passes from the one housing interior portion 4*a* to the other 4*b*, here into the annular space 46 and to the rolling-contact bearing 11, in order to lubricate and optionally also cool and/or flush said region. An adapted cross-sectional shape arises, for example, when two e.g. half-round through-channels 45 are disposed opposite one another, into which a common round or square thrust pin 48 is inserted with slight motional clearance, as is shown on the right in FIG. 7.

It is advantageous to construct the through-channels 45 in such a way that they both perform a guide function for the thrust pins 48 and form at least one passage for the fluid. This may be achieved in that the number of through-channels 45 is greater than the number of thrust pins 48 and so at least one through-channel 45 may be used as a free passage. This may however also be achieved in that the cross-sectional shape of the through-channels 45 differs from the cross-sectional shape of the thrust pins 48. A suitable choice for said purpose is a polygonal shape for the through-channels 45 and a round shape for the thrust pins 48. In said case also, mutually opposing through-channels 45, which are e.g. polygonal in cross section, may receive a common thrust pin 48 of a different, e.g. round cross-sectional shape, as is shown on the left in FIG. 7. In said case, the through-channels 45 may perform a guide function for the thrust pins 48 in that the latter are linearly guided and free through-channel cross sections 45*a* remain, through which a flow of fluid may occur.

A common feature of all of the embodiments according to the invention is that a weakening of the tooth flanks 43*c* and 44*c* is avoided. Since no teeth 43*a*, 44*a* are omitted, despite the through-channels 45 an effective connection between driving shaft 7 and cylinder drum 17 is created.

What is claimed is:

1. Axial piston engine (1) having a housing (2), the housing interior (4) of which contains a cylinder drum (17)

and a swash plate (26) disposed axially adjacent to the latter, wherein disposed in the cylinder drum (17) and extending substantially parallel to the center line of the latter is a plurality of piston bores (21), in which pistons (23) are displaceably guided, of which the piston ends facing the swash plate (26), wherein a driving shaft (7) is rotatably mounted in the housing (2) and is connected to said cylinder drum so as to be rotatable in conjunction therewith by a multitooth coupling (19) having a regular alternating arrangement of mutually meshing teeth (43*a*, 44*a*) and tooth spaces (43*b*, 44*b*) in peripheral direction, and wherein disposed in the region of the multitooth coupling (19) is at least one through-channel (45), which extends substantially parallel to the axis of rotation of the driving shaft (7) and from the one side of the multitooth coupling (19) to the other, characterized in that the through-channel (45) is disposed between at least one tooth tip surface (43*d*, 44*d*) and a tooth space bottom surface (43*e*, 44*e*) lying opposite the tooth tip surface such that a pin having a circular radial dimension can be placed in the through channel such that the radial center of the pin is positioned substantially equidistant from a top of the tooth tip surface and a bottom surface of the tooth space bottom surface.

2. Axial piston engine according to claim 1, characterized in that the cross-sectional shape of the at least one said through-channel (45) is rounded or U-shaped.

3. Axial piston engine according to claim 1, characterized in that the cross-sectional shape of the at least one said through-channel (45) is selectively polygonal, triangular or square.

4. Axial piston engine according to one of the preceding claims, characterized in that the at least one said through-channel (45) extends in bath mutually opposing tooth tip surfaces (43*d*) and tooth space bottom surfaces (44*d*).

5. Axial piston engine according to claim 1, characterized in that a plurality of said through-channels (45) are peripherally spaced about said multitooth coupling and are disposed each respectively in a tooth tip surface (43*d*, 44*d*) and/or a tooth space bottom surface (43*e*, 44*e*).

6. Axial piston engine according to claim 5, characterized in that a thrust pin (48) is disposed as part of a mechanical penetration and/or connecting apparatus in each of a plurality of said through-channels (45) arranged so as to be distributed over the periphery and being longer than the width of said multitooth coupling (19).

7. Axial piston engine according to claim 6, characterized in that the thrust pins (28) are biased by the action of a spring (42) towards a return apparatus (39) for sliding pads (29).

8. Axial piston engine according to claim 6, characterized in that the shape and size of the cross section of the through-channels (45) are adapted to correlate to the shape and size of the cross section of the thrust pins (48) arranged therein.

9. Axial piston engine according to claim 6, characterized in that the through-channels (45) and the thrust pins (48) disposed therein have different cross-sectional shapes.

10. Axial piston engine according to claim 6, characterized in that the thrust pins (48) have a round cross-sectional shape.

11. Axial piston engine according to claim 6, characterized in that a thrust ring (49) is disposed between the ends of the thrust pins (48) remote from the return apparatus (33) and a pressure spring (42) formed by a cylindrical helical spring.

12. Axial piston engine according to claim 11, characterized in that the thrust ring (49) and the thrust pins (48) are of an integral construction.

13. Axial piston engine (1) having a housing (2), the housing interior (4) of which contains a cylinder drum (17) and a swash plate (26) disposed axially adjacent to the latter, wherein disposed in the cylinder drum (17) and extending substantially parallel to the center line of the latter is a plurality of piston bores (21), in which pistons (23) are displaceably guided, of which the piston ends facing the swash plate (26), wherein a driving shaft (7) is rotatably mounted in the housing (2) and is connected to said cylinder drum so as to be rotatable in conjunction therewith by a multitooth coupling (19) having a regular alternating arrangement of mutually meshing teeth (43*a*, 44*a*) and tooth spaces (43*b*, 44*b*) in peripheral direction, and wherein disposed in the region of the multitooth coupling (19) is at least one through-channel (45), which extends substantially parallel to the axis of rotation of the driving shaft (7) and from the one side of the multitooth coupling (19) to the other, characterized in that the through-channel (45) comprises a groove which is disposed between at least one tooth tip surface (43*d*, 44*d*) and a tooth space bottom surface (43*e*, 44*e*) lying opposite the tooth tip surface, and is selectively located in the tooth top surface, in the tooth space bottom surface, or in both the tooth tip and tooth bottom space surfaces such that a pin having a circular radial dimension can be placed in the through channel such that the radial center of the pin is positioned substantially equidistant from a tot of the tooth tip surface and a bottom surface of the tooth space bottom surface.

* * * * *